US007774902B2

(12) United States Patent
Whyzel

(10) Patent No.: US 7,774,902 B2
(45) Date of Patent: Aug. 17, 2010

(54) GRAB BAR

(76) Inventor: Robert H. J. Whyzel, 2980 Forestridge Place, Coquitlam, BC (CA) V3E 3M6

( * ) Notice: Subject to any disclaimer, the term of this patent is extended or adjusted under 35 U.S.C. 154(b) by 609 days.

(21) Appl. No.: 11/707,522

(22) Filed: Feb. 15, 2007

(65) Prior Publication Data

US 2008/0142462 A1 Jun. 19, 2008

(51) Int. Cl.
*A47H 1/00* (2006.01)

(52) U.S. Cl. ..... 16/436; 211/105.1; 211/123; 4/576.1; 4/611; 4/DIG. 15

(58) Field of Classification Search ... 211/105.1–105.6, 211/16, 88; 248/200.1; 16/436, 412, 438; 4/576.1–577.1
See application file for complete search history.

(56) References Cited

U.S. PATENT DOCUMENTS

| | | | | | |
|---|---|---|---|---|---|
| 573,410 | A * | 12/1896 | Hemphill | 211/123 |
| 2,067,591 | A * | 1/1937 | Balmer | 4/576.1 |
| D190,627 | S * | 6/1961 | Miller | D8/302 |
| 3,156,944 | A * | 11/1964 | Bohn | 16/412 |
| 3,813,071 | A * | 5/1974 | Noryd | 248/251 |
| 4,155,312 | A * | 5/1979 | Thorkildson | 108/137 |
| D284,539 | S * | 7/1986 | Baumgarten | D7/393 |
| 4,638,529 | A * | 1/1987 | Katona | 16/436 |
| 5,050,750 | A * | 9/1991 | Mason | 211/123 |
| 5,411,145 | A * | 5/1995 | Parks | 211/50 |
| 5,876,009 | A * | 3/1999 | Simoncioni, Jr. | 248/339 |
| 6,213,437 | B1 * | 4/2001 | Robbins | 248/261 |
| 6,655,538 | B2 * | 12/2003 | Saulnier-Matteini | 211/153 |
| 7,131,616 | B2 * | 11/2006 | Livingstone | 248/304 |
| D540,145 | S * | 4/2007 | Berberet | D8/316 |
| D557,593 | S * | 12/2007 | DePew | D8/373 |
| 7,331,296 | B1 * | 2/2008 | Wood | 108/402 |
| 7,373,694 | B1 * | 5/2008 | Kopp | 16/412 |
| D589,777 | S * | 4/2009 | Brockington et al. | D8/302 |
| D596,918 | S * | 7/2009 | Menzies | D8/315 |
| 2004/0195194 | A1 * | 10/2004 | Belokin et al. | 211/87.01 |

OTHER PUBLICATIONS

Grab Bar, Snap on Flange, online: <http://www.securingcosmos.com/shopexd.asp?id=7035>, accessed: Nov. 17, 2006, p. 1.
Security Grab Bar, online: <http://www.securingcosmos.com/shopexd.asp?id=7036>, accessed: Nov. 17, 2006, p. 1.

(Continued)

*Primary Examiner*—Darnell M Jayne
*Assistant Examiner*—Andres Gallego
(74) *Attorney, Agent, or Firm*—Laurence C Boner

(57) ABSTRACT

A grab bar for projecting from a structure to a projecting side of the grab bar includes a user support member operable to support a user, the user support member being disposed at the projecting side of the grab bar; and an extending member attached to the user support member and dimensioned to extend between the projecting side and an attachment side of the grab bar opposite the projecting side, whereby an upper edge of the grab bar extends from the extending member upwardly and away from the attachment side at a first end of the grab bar and extends upwardly and away from the projecting side at a second end of the grab bar opposite the first end.

20 Claims, 3 Drawing Sheets

OTHER PUBLICATIONS

Stainless Steel Suicide Resistant Grab Bar, online: <http://www.securingcosmos.com/shopexd.asp?id=42255>, accessed: Nov. 17, 2006, p. 1.

Safe-T Grab Bar, online: <http://www.securingcosmos.com/shopexd.asp?id=7722>, accessed: Nov. 17, 2006, p. 1.

SAFEBAR, online: <http://www.4ifp.com/images/IFP-Safebar.pdf>, accessed: Nov. 17, 2006, pp. 1-2.

SP3 Grab Bar, online:<http://www.oddballindustries.com/SP3.html>, accessed: Nov. 17, 2006, p. 1.

* cited by examiner

GRAB BAR

BACKGROUND OF THE INVENTION

1. Field of Invention

This invention relates to devices for supporting a user and, in particular, to a grab bar.

2. Description of Related Art

Grab bars mounted to walls conventionally provide a longitudinal bar extending between end sections which mount to the wall. A user may grip the longitudinal bar with their hand for support and assistance in standing and maneuvering. Some grab bars have been designed for compliance with the American Disability Act (ADA).

Some grab bars have longitudinal bars that are not completely enclosed. Such grab bars permit items to be stored or hidden from view within the longitudinal bar, and thus are not suitable for use in prisons, juvenile detention facilities, courthouses, jails, hospitals, institutions, mental health units, community homes and other facilities where the storage of certain items is prohibited.

Some wall mounted grab bars have underside plates extending from the underside of the longitudinal bar to the wall to prevent a rope from being looped around the longitudinal bar in an attempt to inhibit use of the grab bar in committing suicide. However, such grab bars do not prevent a rope from being placed longitudinally adjacent the longitudinal bar atop or above the underside plate between the longitudinal bar and the wall. Thus, such grab bars are not fully effective in inhibiting attempts to commit suicide.

Some wall mounted grab bars include endplates that slope downward and away from the wall between the wall and the longitudinal bar at both ends of the grab bar to prevent a rope from being looped longitudinally adjacent the longitudinal bar about the grab bar. However, such endplates do not prevent a rope from being looped around the longitudinal bar itself.

A grab bar with both an underside plate and endplates at both ends of the grab bar suffers from difficulty in draining fluid that accumulates atop the underside plate. Fluid accumulation can encourage bacterial growth and increase the likelihood of the transmission of infectious diseases, particularly in institutional settings, thereby posing a health risk. Thus, such grab bars are unsuitable for use wherever a fluid may be present, such as in showers, washrooms and areas where food, drink or waste may spill near the grab bar, including in hospitals and similar institutions. Providing drainage through a gap between the underside plate and the wall or between the underside plate and the endplates impairs the ability of the grab bar to inhibit the committing of suicide by permitting wire, thin rope or thread to pass through the gap.

Thus, there is a need for a grab bar that is operable to provide support and assistance to users, inhibits injury and provides fluid drainage.

SUMMARY

The above shortcomings may be addressed by providing, in accordance with one aspect of the invention, a grab bar for projecting from a structure to a projecting side of the grab bar, the grab bar including a user support member operable to support a user, the user support member being disposed at the projecting side of the grab bar; and an extending member attached to the user support member and dimensioned to extend between the projecting side and an attachment side of the grab bar opposite the projecting side, whereby an upper edge of the grab bar extends from the extending member upwardly and away from the attachment side at a first end of the grab bar and extends upwardly and away from the projecting side at a second end of the grab bar opposite the first end.

The upper edge may extend inwardly, upwardly and away from the attachment side at the first end of the grab bar. The upper edge may contact the extending member at the attachment side of the grab bar. The upper edge may contact the extending member at the attachment side of the grab bar. The extending member may be disposed at an incline to facilitate drainage. An end member may be attached at the first end to the extending member and the user support member. The end member may extend inwardly, upwardly and away from the attachment side at the first end of the grab bar. A top edge of the end member may contact the extending member at the attachment side of the grab bar. The grab bar may include a mounting flange for mounting the grab bar to the structure, the mounting flange being disposed at the attachment side of the grab bar. The mounting flange may include a chamfered outer edge. The mounting flange may include a plurality of apertures dimensioned to receive security fasteners, respectively. The grab bar may be substantially planar at the attachment side. The mounting flange may be substantially planar, thereby facilitating mounting the grab bar at a substantially planar surface of the structure. The extending member may include a plurality of substantially planar sections. The plurality of substantially planar sections may include at least one planar section disposed at an incline to facilitate drainage. The user support member may be substantially circumferential in cross-section and may extend longitudinally between the first end and the second end. The user support member may be enclosed, thereby impeding storage within the user support member.

In accordance with another aspect of the invention, there is provided a method of installing a grab bar on a structure, the method including the steps of fastening the grab bar to the structure such that the grab bar projects from the structure to the projecting side of the grab bar; and sealing the grab bar to the structure. Fastening the grab bar as claimed in claim 1 to the structure may involve fastening the grab bar to the structure at an angle facilitating drainage.

In accordance with another aspect of the invention, there is provided a grab bar for projecting from a structure to a projecting side of the grab bar, the grab bar including supporting means for supporting a user, the supporting means being disposed at the projecting side of the grab bar; extending means for extending between the projecting side and an attachment side of the grab bar opposite the projecting side, the extending means being attached to the supporting means; draining means for permitting fluid to drain at a first end of the grab bar; and injury inhibiting means for inhibiting injury to the user, the injury inhibiting means being disposed at a second end of the grab bar opposite the first end.

The grab bar may include mounting means for mounting the grab bar to the structure.

In accordance with another aspect of the invention, there is provided a kit for a grab bar, the kit including: (a) a user support member operable to support a user, the user support member longitudinally extending between a first end and a second end of the user support member; (b) an extending member dimensioned for attachment to the user support member so as to transversely extend from the user support member to an attachment side of the extending member; (c) an end member dimensioned for attachment to the extending member at the first end of the user support member, the end member having a top edge dimensioned for extending inwardly and upwardly away from the attachment side; (d) a second end member dimensioned for attachment at the second end to the user support member, the second end member having a second member top edge dimensioned for extending upwardly away from the user support member; and (e) mounting means for mounting the extending member to a structure at the attachment side of the extending member.

Other aspects and features of the present invention will become apparent to those of ordinary skill in the art upon review of the following description of specific embodiments of the invention in conjunction with the accompanying figures.

BRIEF DESCRIPTION OF THE DRAWINGS

In drawings which illustrate, by way of example only, embodiments of the invention.

DETAILED DESCRIPTION

A grab bar apparatus for projecting from a structure to a projecting side of the grab bar includes: (a) supporting means for supporting a user, the supporting means being disposed at the projecting side of the grab bar; (b) extending means for extending between the projecting side and an attachment side of the grab bar opposite the projecting side, the extending means being attached to the supporting means; (c) draining means for permitting fluid to drain at a first end of the grab bar; and (d) injury inhibiting means for inhibiting injury to the user, the injury inhibiting means being disposed at a second end of the grab bar opposite the first end. The grab bar may further include mounting means for mounting the grab bar to the structure.

Figure 1:
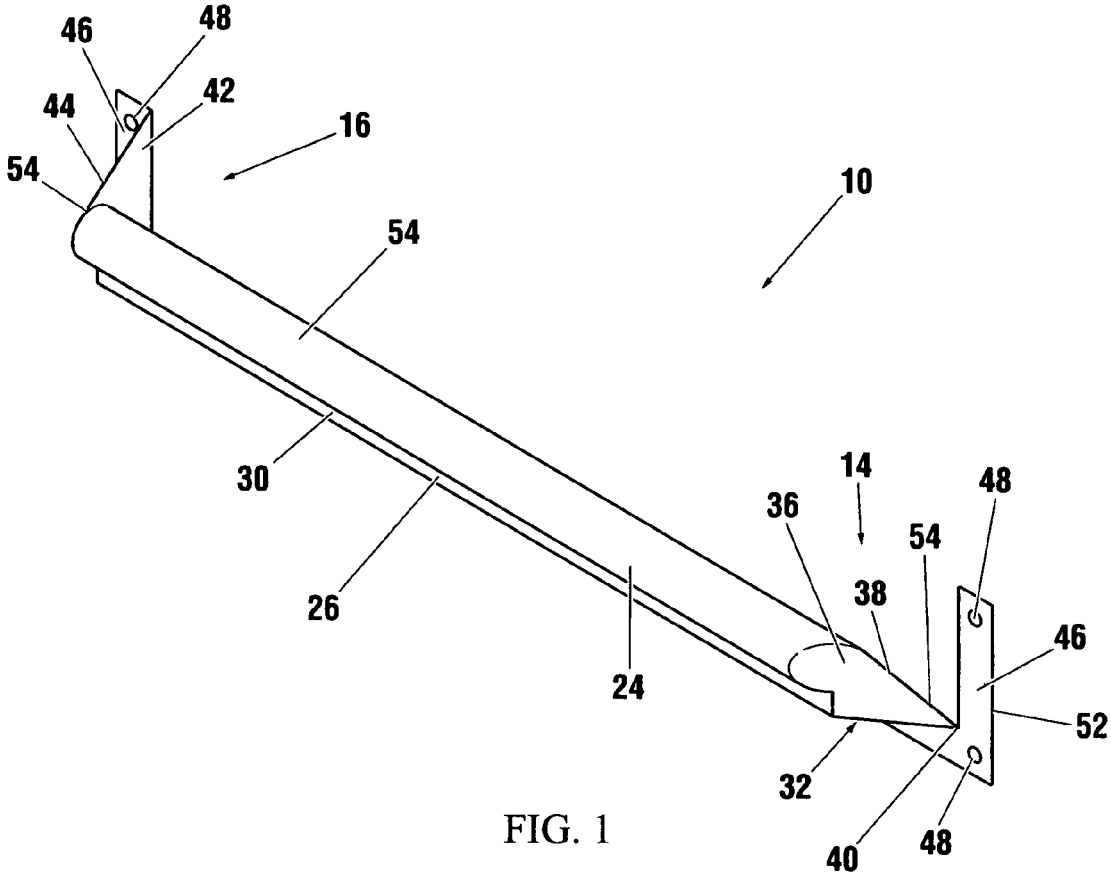
FIG. 1 is a perspective view of a grab bar according to a first embodiment of the invention.
Figure 2:
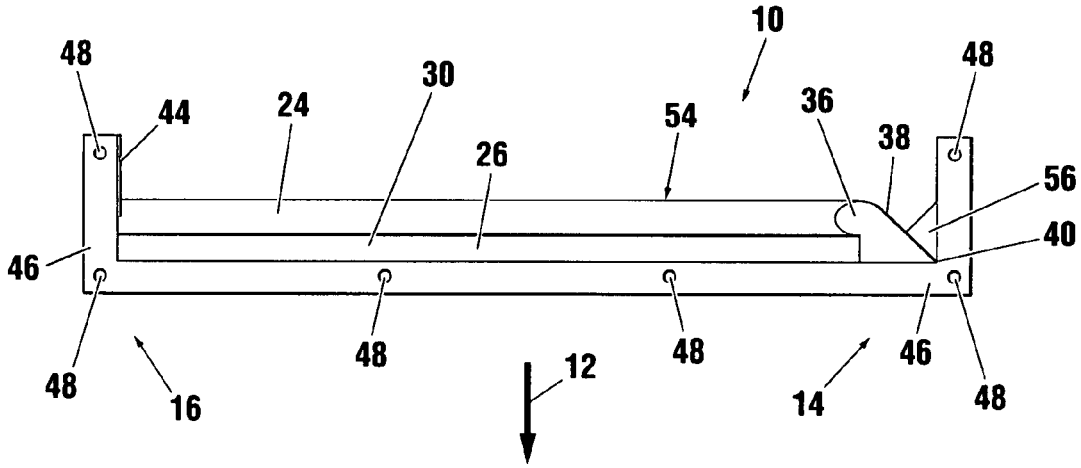
FIG. 2 is a front elevation view of a variation of the grab bar shown in FIG. 1 in which a mounting plate of the grab bar is varied.
Figure 3:
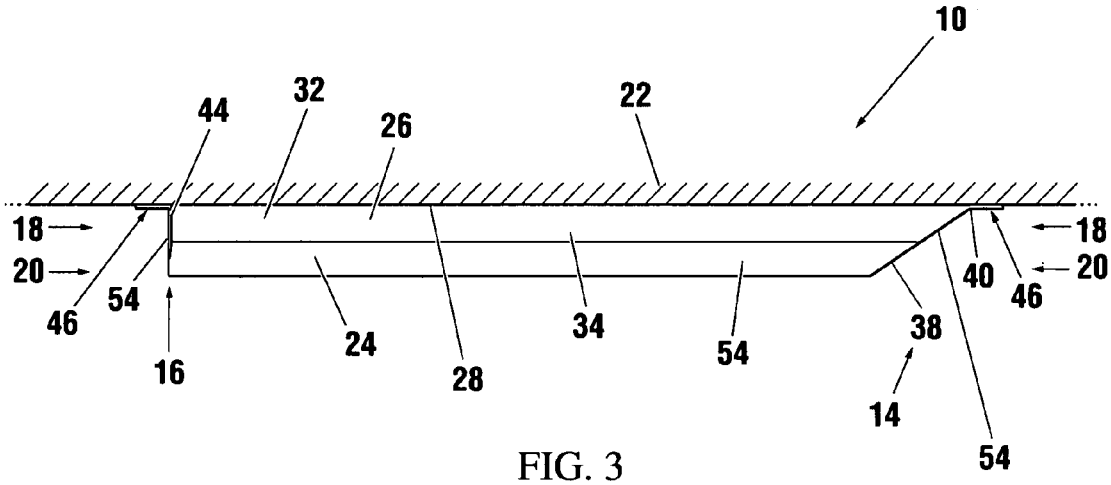
FIG. 3 is a top plan view of the grab bar shown in FIG. 1, showing an extension piece.

Referring to FIGS. 1 to 3, the grab bar according to a first embodiment of the invention is shown generally at 10. The grab bar 10 provides support to a user, including any or all of assisting a user in standing, sitting, bending, raising, walking, propelling themselves or otherwise maneuvering. The shape and material of the grab bar 10 may be selected for compliance with the American Disability Act (ADA), for example. The material of the grab bar 10 preferably includes metal, which may be stainless steel, aluminum or similar metal. In some embodiments, the material of the grab bar 10 includes plastic, rubber, teflon, wood and other suitable materials including combinations thereof.

For the purposes of the description provided herein, the upward direction is opposite to the downward direction indicated by the arrow 12 shown in FIG. 2. The upward and downward directions are vertical directions perpendicular to horizontal directions. The grab bar 10 extends longitudinally in a substantially horizontal direction between a first end 14 (shown relatively to the right in FIGS. 1 to 3) and a second end 16 (shown relatively to the left in FIGS. 1 to 3) of the grab bar 10. The grab bar 10 also extends transversely in a substantially horizontal direction between an attachment side 18 (FIG. 3) and a projecting side 20 (FIG. 3) of the grab bar 10 opposite the attachment side 18. The inward and outward directions are defined as substantially toward and substantially away from the center of the grab bar 10, respectively. The grab bar 10 is intended to be useable in the presence of a gravitational force acting substantially in the downward direction 12, acting in a direction slightly offset from the downward direction 12 or other angle relative to the downward direction 12.

The grab bar 10 can be formed integrally within or mounted to a structure, such as a wall lining or the wall 22 shown partially in FIG. 3.

The grab bar 10 includes a user support member, such as the gripping bar 24 shown in FIGS. 1 to 3. The gripping bar 24 longitudinally extends nearly the full length of the grab bar 10 between the first end 14 and the second end 16 of the grab bar 10. The first end 14 and the second end 16 may be separated longitudinally by any length, including lengths between 10 cm. (approximately 4 inches) and 10 m. (approximately 33 feet), for example. Typical lengths of the grab bar 10 include lengths between 50 cm. (approximately 20 inches) and 3 m. (approximately 10 feet).

The gripping bar 24 is operable to support a user, including providing a surface thereon which a user may grip with one or two hands to assist the user with any or all of standing, sitting, bending, raising, walking or otherwise maneuvering. Preferably, the gripping bar 24 has a curved, arcuate or rounded cross-section as shown in FIGS. 1 and 2. In some embodiments, the gripping bar 24 has a substantially circular cross-sectional shape. Other shapes are possible. The shape and material of the gripping bar 24 may be selected for compliance with industry standards relating to hand support and hand gripping, for example. Preferably, the material of the gripping bar 24 includes metal, and may be stainless steel, aluminum or other metal. In some embodiments, the material of the gripping bar 24 includes plastic, rubber, teflon, wood and other suitable materials, including combinations thereof. In some embodiments, the gripping bar 24 has a knurled, gnarled, scored, randomly varied or other textured surface to increase friction during use.

An extending member, such as the extension piece 26 shown in FIGS. 1 to 3, extends from the gripping bar 24 to the attachment side 18 of the grab bar 10. The extension piece 26 may be made of any material in which the gripping bar 24 may be made. The extension piece 26 and the gripping bar 24 may be made of similar or different materials. Preferably, the extension piece 26 has an edge 28 dimensioned to abut the wall 22 or other structure. Abutting the edge 28 against the wall 22 advantageously inhibits, including possibly preventing, a fastening line, fishing line, rope, cord, cable, string, thread, twine, wire, elongated strip or other length of material (not shown) from being passed between the grip bar 10 and the wall 22, which in turn inhibits, including possibly preventing, the fastening line or similar from being looped around the grab bar 10, thereby inhibiting use of the grab bar 10 to cause injury, such as by strangling, tying, binding, committing murder and committing suicide, for example. In this manner, the extension piece 26 is advantageously operable as an anti-suicide plate and provides the grab bar 10 with a safety feature.

The extension piece 26 may be formed from any number of different sections, which may be angled with respect to each other, including being made of a single section which may be planar, curved, arcuate or a combination thereof. Additionally or alternatively, the extension piece 26 may be formed from a plurality of sections which may be planar, curved, arcuate or a combination or combinations thereof. The extension piece 26 is shown in FIGS. 1 and 2 as including a vertical section 30 extending substantially in the downward direction 12 from the gripping bar 24 and a horizontal section 32 extending substantially horizontally from the bottom of the vertical section 30 to the attachment side 18 of the grab bar 10. However, other shapes and dimensions are possible, provided the extension piece 26 is dimensioned to extend between the projecting side 20 and the attachment side 18 of the grab bar 10. For example, the horizontal section 32 may be planar and extend strictly in the horizontal directions, as shown in FIGS. 1 and 2, or may be sloped, inclined and/or include an inclined portion such that fluid accumulating on the top surface 34 of the extension piece 26, including the horizontal section 32, is directed by gravitational force toward the first end 14 and/or the attachment side 18 of the grab bar 10.

The grab bar 10 preferably includes an end member such as the endplate 36 shown in FIGS. 1 to 3. The endplate 36 can be attached at the first end 14 to the gripping bar 24 and the extension piece 26, including being integrally formed with the grab bar 10. Additionally or alternatively, the endplate 36 may be welded, glued, adhered, fastened, including bolted, screwed or rivetted, or otherwise attached, including combinations thereof, to the gripping bar 24 and the extension piece 26. The endplate 36 may be made of any material in which other components of the grab bar 10 may be made. The endplate 36 may be made of similar or different materials from other components of the grab bar 10. Preferably, the endplate 36 is formed of substantially planar metal, such as sheet metal, and may be made of stainless steel, for example.

As shown in FIGS. 1 to 3, the top edge 38 of the endplate 36 makes contact with the extension piece 26 at a contact point 40. Preferably, the top edge 38 extends from the contact point 40 upwardly and away from the attachment side 18, and extends inwardly and away from the first end 14. In general, however, the top edge 38 may traverse any path extending away from the contact point 40 which includes at least a portion thereof that is substantially upwardly inclined, including extending substantially perpendicularly away from the attachment side 18, extending outwardly at or near the first end 14, or combinations thereof, for example.

The inclined nature of the top edge 38 advantageously inhibits, including possibly preventing, a fastening line or similar from being looped atop the grab bar 10 at the first end 14, thereby inhibiting use of the grab bar 10 to cause injury, such as by strangling, tying, binding, committing murder and committing suicide, for example. In this manner, the first end 14 is operable as a safety end of the grab bar 10. While this safety first end 14 is shown relatively to the right in FIGS. 1 to 3, the first end 14 may be disposed at either end of the grab bar 10. An optimal angle, angles or curvature of incline of the top edge 38 between the attachment side 18 and the projecting side 20, and an optimal angle, angles or curvature of the top edge 38 between the first end 14 and the second end 16 may be selected to minimize opportunities for a fastening line or similar to catch hold on the grab bar 10 or otherwise remain looped atop the grab bar 10 at the first end 14. Preferably, the top edge 38 extends from the attachment side 18 toward the projecting side 20 at an upward angle between 25 degrees and 55 degrees from the horizontal, and extends from the contact point 40 toward the second end 16 at an upward angle between 30 degrees and 70 degrees from the horizontal.

When the grab bar 10 is mounted to the wall 22, the contact point 40 is preferably disposed at or near the attachment side 18 of the grab bar 10 adjacent the wall 22. In some embodiments, the contact point 40 is located at the first end 14 intermediate of the attachment side 18 and the gripping bar 24. The contact point 40 advantageously provides a drainage point where fluid may drain from the top surface 34 of the extension piece 26, thereby avoiding the accumulation of fluid, such as stale pooled water, and alleviating health risks associated therewith, including the transmission of infectious diseases.

The grab bar 10 at the second end 16 preferably includes a second end member such as the second endplate 42 shown in FIGS. 1 to 3. The second endplate 42 may be attached at the second end 16 of the grab bar 10 in any manner in which the endplate 36 may be attached. The second endplate 42 and the endplate 36 may be attached in the same or different manners, for example. The material of the second endplate 42 may be any material in which the endplate 36 may be made. The materials of the second endplate 42 and the endplate 36 may be the same, similar or different materials, for example.

The second endplate 42 includes a second endplate top edge 44 which preferably extends upwardly and away from the projecting side 20. The second endplate top edge 44 preferably extends away from the projecting side 20 substantially perpendicularly to the longitudinal direction of the gripping bar 24, as shown in FIGS. 1 to 3. Additionally or alternatively, the second endplate top edge 44 may extend at other horizontally directed angles away from the projecting side 20, including being curved or arcuate, for example. The second endplate top edge 44 preferably extends from the top of the gripping bar 24 at the second end 16.

The second endplate top edge 44 may extend upwardly at any angle, angles or curvature of incline away from the projecting side 20. The inclined nature of the second endplate 42 at its second endplate top edge 44 advantageously inhibits, including possibly preventing, a fastening line or similar from being looped atop the grab bar 10 at the second end 16, thereby inhibiting use of the grab bar 10 to cause injury, such as by strangling, tying, binding, committing murder and committing suicide, for example. An optimal angle, angles or curvature of incline of the second endplate top edge 44 between the projecting side 20 and the attachment side 18, and an optimal angle, angles or curvature of the second endplate top edge 44 between the first end 14 and the second end 16 may be selected to minimize opportunities for a fastening line or similar to catch hold on the grab bar 10 or otherwise remain looped atop the grab bar 10 at the second end 16. Preferably, the second endplate top edge 44 extends from the projecting side 20 toward the attachment side 18 at an upward angle between 25 degrees and 55 degrees from the horizontal.

Referring to FIGS. 1 to 7, the grab bar 10 preferably includes a mounting flange 46 formed at the attachment side 18 of the grab bar 10. Preferably, the mounting flange 46 is substantially planar such that the grab bar 10 is substantially planar at the attachment side 18. The planar characteristics of the grab bar 10 and mounting flange 46 may include a plurality of planar sections. The grab bar 10 including the mounting flange 46 may be formed with an angled profile to accommodate wall corners (not shown) or other surface contours of the wall 22. For example, the grab bar 10 may extend longitudinally between the first end 14 and a mid-point of the grab bar 10, and continue to extend longitudinally between the mid-point and the second end 16, thereby forming two sections of the grab bar 10 which may be formed at an angle relative to each other. In this manner, the grab bar 10 shown in FIG. 1 can be modified for adjacent mounting to the wall 22 at a corner (not shown) of the wall 22. A plurality of similar sections may be formed at any combination of angles such that the grab bar 10 extends longitudinally between the first end 14 and the second end 16 at a plurality of directions therebetween. Additionally or alternatively, the grab bar 10 may be formed with a curved or arcuate shape for mounting to a curved or arcuate wall 22 surface, for example.

Figure 4:
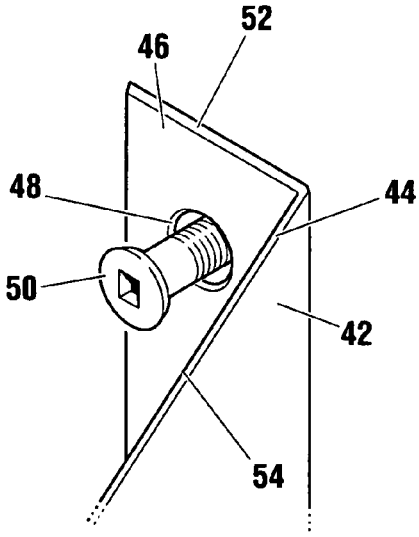
FIG. 4 is a perspective view of a portion of the grab bar shown in FIG. 1, showing a countersunk fastener partly inserted through a chamfered aperture of a partly shown mounting plate.
Figure 5:
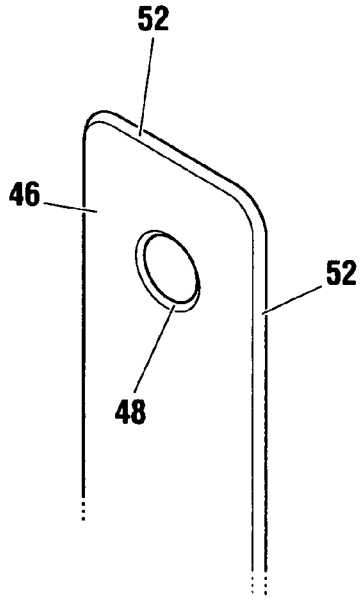
FIG. 5 is a perspective view of a portion of a variation of the grab bar shown in FIG. 1 in which a portion of a mounting plate with rounded corners is shown.

Preferably, the mounting flange 46 includes mounting apertures 48 dimensioned to receive fasteners, including security fasteners such as the countersunk screw 50 shown in FIG. 4. The mounting flange 46 facilitates mounting the grab bar 10 to a structure such as the wall 22. FIG. 4 shows an upper portion of the mounting flange 46 associated with the second end 16 of the grab bar 10. FIG. 5 shows an upper portion of the mounting flange 46 associated with the first end 14 of the grab bar 10.

Referring to FIGS. 4 and 5, the mounting apertures 48 are preferably chamfered to facilitate receiving the countersunk screw 50. The mounting apertures 48 may include a straight, single angled bevel, a chamfer comprising multiple angles, including a plurality of progressively steeper angles, an arcuate chamfer, a chamfer having an irregular profile, or combinations thereof, for example. The mounting apertures 48 are preferably dimensioned to receive countersunk screws 50 or other security fasteners having heads which do not project from the mounting flange 46 when fully received by the mounting apertures 48. The chamfered nature of the mounting apertures 48 inhibit, including possibly preventing, a fastening line or similar, including a thread or wire, from being supported on the mounting flange 46 at the mounting apertures 48 when the grab bar 10 is mounted by security fasteners, thereby inhibiting use of the grab bar 10 to cause injury, such as by strangling, tying, binding, committing murder and committing suicide, for example.

With reference to FIGS. 4 and 5, an outer edge 52 of the mounting flange 46 is preferably bevelled. When the grab bar 10 is mounted to the wall 22, the bevelled outer edge 52 provides an angled surface extending inwardly away from the wall 22 to the remainder of the mounting flange 46. The outer edge 52 may have a straight, single angled bevel as shown in FIGS. 4 and 5, a chamfer comprising multiple angles, including a plurality of progressively steeper angles, an arcuate chamfer, a chamfer having an irregular profile or combinations thereof, for example. Chamfering, including bevelling, the outer edge 52 advantageously inhibits, including possibly preventing, a fastening line or similar, including a thread or wire for example, from being supported on the outer edge 52, including at the top of the mounting flange 46, thereby inhibiting use of the grab bar 10 to cause injury, such as by strangling, tying, binding, committing murder and committing suicide, for example. Chamfering, including bevelling, the outer edge 52 also advantageously inhibits injury by avoiding sharp edges that may be used to cut or scrape, including cutting or scraping human skin, for example. Chamfering, including bevelling, the outer edge 52 obviates the need for a recess in the wall 22, such recess being dimensioned to correspond to the mounting flange 46 for countersink mounting of the grab bar 10 such that the mounting flange 46 becomes flush with the wall 22 and does not project therefrom, in order to obtain the safety advantages described herein of the chamfered mounting flange 46.

As shown in FIG. 5, the outer edge 52 is preferably rounded at each corner to inhibit injury by avoiding sharp edges at corners of the grab bar 10.

While the figures show the mounting flange 46 as integrally formed with the grab bar 10, other mounting methods or schemes are possible. In some embodiments, the mounting flange 46 is attached to the grab bar 10 at the attachment side 18, and may be attached by welding, fastening, including bolting, screwing or rivetting, or by other suitable attachments means. Preferably, the mounting flange 46 is formed from a first portion of the mounting flange 46 disposed at the first end 14 of the grab bar 10, a second portion disposed at the second end 16, and a third portion disposed between the first end 14 and the second end 16. Preferably, the first and second portions are attached to the grab bar 10 at the attachment side 18, such as by welding, and the third portion is integrally formed with the extension piece 26. In some embodiments, the grab bar 10 and mounting flange 46 are integrally formed with a structure. In some embodiments, the grab bar 10 is integrally formed with a structure and no mounting flange 46 is required.

FIGS. 1 and 2 show variations of the mounting flange 46. As shown in FIG. 1, the mounting flange 46 at the first end 14 is substantially rectangular in shape, thereby forming a substantially rectangular first portion thereof. Preferably, the mounting flange 46 includes a brace 56 as shown in FIG. 2. The brace 56 may be integrally formed with the mounting flange 46, including being integrally formed with the first portion of the mounting flange 46. Additionally or alternatively, the brace 56 may be attached to grab bar 10 at the attachment side 18, which may include being attached to the mounting flange 46 or the first portion thereof. The brace 56 may be attached to the grab bar 10 by welding, fastening, including bolting, screwing or riveting, combinations thereof or similar attachment means, for example. The brace 56 advantageously provides additional strength to the grab bar 10 at the first end 14, and advantageously inhibits destruction, removal and other vandalism of the grab bar 10 by preventing the gripping bar 24 at the first end 14 from being displaced away from the mounting flange 46.

Figure 6:
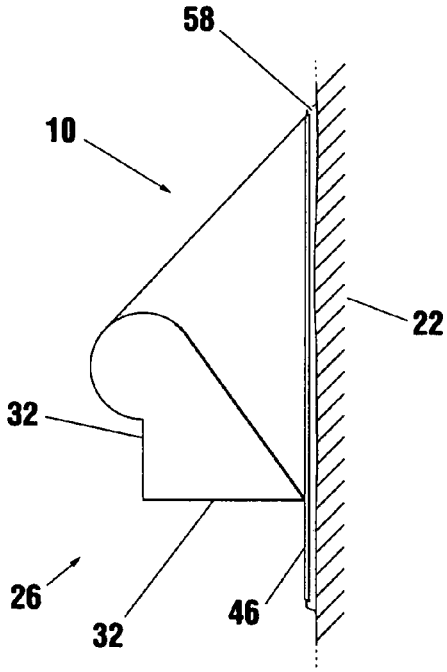
FIG. 6 is a side view of the grab bar shown in FIG. 1, showing a sealing material.
Figure 7:
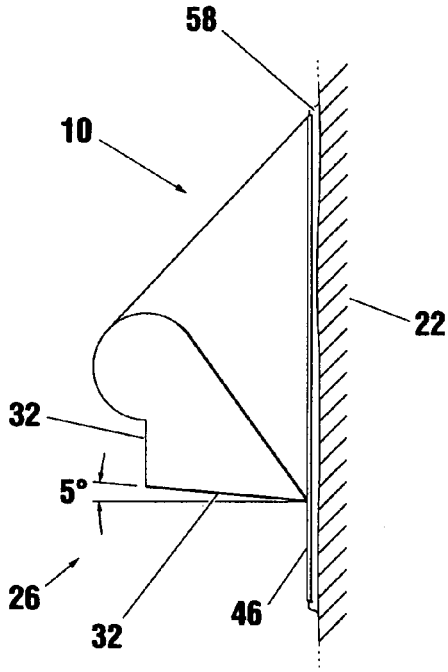
FIG. 7 is a side view of a variation of the grab bar shown in FIG. 6, in which a horizontal section is inclined.

Referring to FIGS. 6 and 7, a sealing material 58 may be applied to the grab bar 10 around the outer edge 54, inserted between the grab bar 10 and the wall 22, or both applied to the grab bar 10 around the outer edge 54 and inserted between the grab bar 10 and the wall 22. The sealing material 58 may be any sealant, caulking or similar material. Preferably, the sealing material 58 is waterproof or water-resistant, and may be non-permeable or otherwise operable to inhibit the insertion of a wire, fastening line or similar into the sealing material 58 between the grab bar 10 and the wall 22. The sealing material 58 advantageously permits the grab bar 10 to be mounted to a wall 22 surface in circumstances where the attachment side 18 of the grab bar 10 and the wall 22 surface may not be in substantial alignment, while still providing safety features of the grab bar 10 described herein.

FIG. 7 shows a variation of the grab bar 10 shown in FIG. 6 in which the extension piece 26 is disposed at an incline to facilitate drainage. The exemplary embodiment shown in FIG. 7 illustrates the horizontal section 32 of the extension piece 26 being disposed at an incline to facilitate drainage. The horizontal section 32 is preferably sloped or inclined such that fluid accumulating on the top surface 34 (FIG. 3) of the extension piece 26, including the horizontal section 32, is directed by gravitational force toward the attachment side 18 of the grab bar 10 when the grab bar 10 is mounted such that the gravitational force acts vertically. FIG. 7 shows the horizontal section 32 as having a slope or incline of approximately 5 degrees from horizontal, although other angles of incline are possible. The angle of incline may be selected or adjusted to correspond to a mounted orientation of the grab bar 10 with respect to the direction of gravitational force. Preferably, the horizontal section 32 is inclined between zero and ten (10) degrees relative to the horizontal directions.

Referring back to FIG. 1, the grab bar 10 has an upper edge 54 extending from the mounting flange 46 at the first end 14 to the mounting flange 46 at the second end 16 of the grab bar 10. As shown in the figures, the upper edge 54 extends from the extension piece 26 at the contact point 40 upwardly and away from the attachment side 18 at the first end 14 and extends upwardly and away from the projecting side 20 at the second end 16 of the grab bar 10. Preferably, the upper edge 54 is coincident with the top edge 38, the top of the gripping bar 24 and the second endplate top edge 44. However, other arrangements are possible. By way of example, the upper edge of the grab bar 10 may be formed from any number of components of the grab bar 10, including being formed from a single continuous component of the grab bar 10, for example.

Thus, there is provided a grab bar for projecting from a structure to a projecting side of the grab bar, the grab bar including a user support member operable to support a user, the user support member being disposed at the projecting side of the grab bar; and an extending member attached to the user support member and dimensioned to extend between the projecting side and an attachment side of the grab bar opposite the projecting side, whereby an upper edge of the grab bar extends from the extending member upwardly and away from the attachment side at a first end of the grab bar and extends upwardly and away from the projecting side at a second end of the grab bar opposite the first end.

Method of Installation

Preferably and as shown in FIGS. 1 to 7, the grab bar 10 may be installed to the wall 22 by fastening the grab bar 10 to the wall 22 such that the grab bar 10 projects from the wall 22 to the projecting side 20 of the grab bar 10. Fastening the grab bar 10 to the wall 22 may include receiving a countersunk screw 50 into each mounting aperture 48 of the mounting flange 46 of the grab bar 10; and rotating the countersunk screws 50 until no substantial part of any countersunk screw 50 projects from the mounting flange 46. Additionally or alternatively, fastening the grab bar 10 to the wall 22 or other structure may include welding the grab bar 10 to the wall. Welding the grab bar 10 to the wall 22 may include welding the mounting flange 46 at the mounting apertures 48 to the wall 22 so as to plug the apertures 48. The mounting apertures 48 may be plug welded so that welding material provides a smooth surface along the mounting flange 46 without sharp edges or points that may cause injury, or be used to cause injury. Additionally or alternatively, finishing steps such as filing, grinding or other removing of material may be performed to obtain a substantially smooth surface of the installed grab bar 10.

Installing the grab bar 10 at the wall 22 may also include sealing the grab bar 10 to the wall 22, such as by applying sealing material 58 at any or all of the outer edge 52 of the mounting flange 46, the edge 28 of the extension piece 26, and points of contact between the grab bar 10 and the wall 22.

The grab bar 10 may be installed on the wall 22 at an angle to facilitate drainage. For example, the grab bar 10 may be fastened to the wall 22 such that the downward direction 12 (FIG. 2) is not parallel to the direction of gravitational force. In this manner, the top surface 34 (FIG. 3) of the horizontal section 32 may be tilted with respect to the direction of gravitational force so as to create a force component of gravity along the top surface 34 urging any fluid which may be present on the top surface 34 toward the first end 14. The angle of tilt can be any acute angle, and in typical applications is preferably between zero and 45 degrees. In some applications, the angle of tilt may be less than 10 degrees.

Thus, there is provided a method of installing a grab bar on a structure, the method including fastening the grab bar to the structure such that the grab bar projects from the structure to the projecting side of the grab bar; and sealing the grab bar to the structure.

Kit

Various components making up the grab bar 10 may be provided in a kit of grab bar 10 components. For example, an existing grab bar without all of the advantageous features of the grab bar 10 may be modified by removing one or more of its components, replacing one or more of its components with corresponding grab bar 10 components, adding one or more grab bar 10 components to the existing grab bar, or otherwise using one or more grab bar 10 components to upgrade the existing grab bar. The kit may include any or all of the gripping bar 24, the extension piece 26, the vertical section 30 of the extension piece 26, the horizontal section 32 of the extension piece 26, the endplate 36, the second endplate 42, the mounting flange 46, one or more portions of the mounting flange 46, one or more countersunk screws 50, brace 56 and sealing material 58, for example. The kit may include grab bar 10 components in various stages of assembly, including unassembled and partly assembled, for example. The kit may include sub-assembly units of assembled components not forming the complete grab bar 10, for example. In some embodiments, the kit includes at least one fully assembled grab bar 10 and a number of countersunk screws 50.

Assembly of the kit may involve welding, fastening, screwing, riveting, nailing, gluing, adhering, sealing and other assembly techniques, for example. Installation of the kit and use of the kit for upgrading one or more existing grab bars may involve techniques similar to the assembly techniques described herein and/or other suitable techniques.

Operation

In operation, any elongated material such as a fastening line or similar will slip off the grab bar 10 when weight is placed on it, including slipping off the first end 14, the second end 16, the mounting flange 46 and/or security fasteners or welding material received in the mounting apertures 48 when weight is placed on it, thereby preventing attachment or securing of the fastening line or similar to the grab bar 10 in addition to providing drainage along the extension piece 26 and off the grab bar 10 at the contact point 40.

Sloped Endplate Variation

Figure 8:
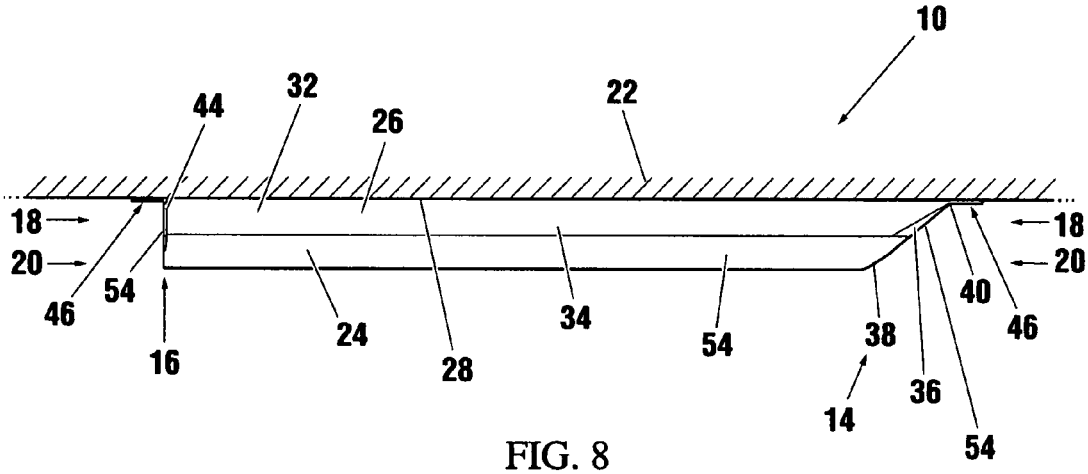
FIG. 8 is a top view of a variation of the grab bar shown in FIG. 1, showing an outwardly sloped endplate.

Referring to FIG. 8, the endplate 36 preferably slopes outwardly with upward extension away from the extension piece 26 such that the top edge 38 is disposed outwardly relative to the lower portion of the endplate 36 where the endplate 36 makes contact with the extension piece 26 apart from the contact point 40. Although the endplate 36 is shown in the figures as being substantially planar, other shapes for an end member are possible. For example, the endplate 36 may be curved, including curving outwardly where the endplate 36 extends upwardly from the extension piece 26. The endplate 36, the second endplate 42, or both the endplate 36 and the second endplate 42 may be outwardly sloped, including tilted or curved.

The upwardly outward slope of the endplate 36 advantageously inhibits, including possibly preventing, an object connected to or forming part of a fastening line or similar from being secured in the space defined inwardly adjacent the endplate 36 such that the fastening line or similar can be looped atop the upper edge 54, which may include the top edge 38, thereby inhibiting use of the grab bar 10 to cause injury, such as by strangling, tying, binding, committing murder and committing suicide, for example. By way of example, the upwardly outward slope of the endplate 36 advantageously inhibits a large knot tied in a bedsheet or similar material, including clothing and other cloth materials (not shown), from being secured in the space defined inwardly adjacent the endplate 36 with the remainder of the material (not shown) looped around the upper edge 54 and securely hanging from the grab bar 10.

An optimal angle, angles or curvature of upwardly outward slope of the endplate 36 may be selected to minimize opportunities for securing a fastening line or similar, including cloth material, onto the grab bar 10 at the first end 14. Preferably, the endplate 36 extends upwardly from the extension piece 26 at an angle of slope between 0 degrees and 45 degrees from the vertical, and may have an optimal angle of slope between 20 degrees and 30 degrees from the vertical.

While specific embodiments of the invention have been described and illustrated, such embodiments should be considered illustrative of the invention only. The invention may include variants not described or illustrated herein in detail. For example, gripping of the gripping bar 24 may be facilitated by applying a gripping material (not shown) to the surface of the gripping bar 24. Thus, the embodiments described and illustrated herein should not be considered to limit the invention as construed in accordance with the accompanying claims.

REFERENCE CHARACTERS FOR GRAB BAR grab bar 10
arrow 12
first end 14 (of grab bar 10)
second end 16 (of grab bar 10)
attachment side 18 (of grab bar 10)
projecting side 20 (of grab bar 10)
wall 22
gripping bar 24
extension piece 26
edge 28 (of extension piece 26)
vertical section 30 (of extension piece 26)
horizontal section 32 (of extension piece 26)
top surface 34 (of horizontal section 32)
endplate 36
top edge 38 (of endplate 36)
contact point 40
second endplate 42
second endplate top edge 44
mounting flange 46
mounting apertures 48
countersunk screw 50
outer edge 52 (of mounting flange 46)
upper edge 54 (of the grab bar 10)
brace 56
sealing material 58

What is claimed is:

1. A grab bar for projecting from an attachment side of the grab bar for location adjacent to a structure towards a projecting side of the grab bar, the grab bar comprising:

(a) a user support member operable to support a user, said user support member being disposed at the projecting side of the grab bar; and (b) an extending member attached to said user support member and dimensioned to extend between said user support member at said projecting side and said attachment side of the grab bar opposite said projecting side, whereby an upper surface of the grab bar extends from said extending member upwardly and away from the attachment side towards the projecting side at the first end of the grab bar and extends upwardly and away from the projecting side towards the attachment side at the second end of the grab bar opposite said first end; and wherein said extending member is disposed at an upward incline between said first end and said second end to facilitate drainage from said first end through the gap.

2. The grab bar of claim 1 wherein said upper surface extends inwardly and upwardly away from the attachment side towards the projecting side at said first end of the grab bar.

3. The grab bar of claim 1 wherein said upper surface contacts said extending member at the attachment side of the grab bar.

4. The grab bar of claim 2 wherein said upper surface contacts said extending member at the attachment side of the grab bar.

5. The grab bar of claim 1 comprising an end plate attached at said first end to said extending member and said user support member.

6. The grab bar of claim 5 wherein a top edge of said end plate extends inwardly and upwardly away from the attachment side at said first end of the grab bar.

7. The grab bar of claim 6 wherein said top edge contacts said extending member at the attachment side of the grab bar.

8. The grab bar of claim 7 wherein said end plate extends outwardly with upward extension from said attachment side towards said projecting side.

9. The grab bar of claim 1 wherein said mounting flange at the first end comprises a chamfered outer edge.

10. The grab bar of claim 1 wherein said mounting flange at the first end comprises a plurality of apertures dimensioned to receive security fasteners, respectively.

11. The grab bar of claim 8 wherein the mounting flange at the first end has a chamfered outer edge.

12. The grab bar of claim 1 wherein the grab bar is substantially planar at the attachment side.

13. The grab bar of claim 11 wherein said mounting flange is substantially planar, and adapted for mounting the grab bar at a substantially planar surface of the structure.

14. The grab bar of claim 11 wherein said extending member comprises a plurality of substantially planar sections.

15. The grab bar of claim 14 wherein said plurality of substantially planar sections includes at least one planar section disposed at the upward incline between a first end and a second end thereof to facilitate the drainage from said first end of said at least one planar section.

16. The grab bar of claim 11 wherein said user support member is substantially circumferential in cross-section and extends longitudinally between said first end and said second end.

17. The grab bar of claim 5 wherein an outer surface of said user support member is enclosed by the end plate, thereby impeding storage within said user support member.

18. A method of installing a grab bar on a structure, the method comprising:

(a) providing a grab bar according to claim 1 and fastening the grab bar to the structure such that the attachment side of the grab bar abuts and projects from the structure towards the projecting side of the grab bar; and (b) sealing the grab bar to the structure.

19. The method of claim 18 wherein fastening the grab bar additionally comprises fastening the grab bar to the structure at an angle facilitating drainage from the first end of the grab bar.

20. A kit for a grab bar, the kit comprising:

(a) a user support member operable to support a user, said user support member longitudinally extending between a first end and a second end of the user support member;

(b) an extending member dimensioned for attachment to the user support member so as to transversely extend from the user support member to an attachment side of the extending member;

(c) a first end member dimensioned for attachment to said extending member at said first end of said user support member, said end member having a top edge dimensioned for extending inwardly and upwardly away from the attachment side towards the user support member;

(d) a second end member dimensioned for attachment at said second end to said user support member, said second end member having a second member top edge dimensioned for extending upwardly away from the user support member towards the attachment side of the extending member; and (e) mounting means for mounting said extending member to a structure at the attachment side of said extending member (f) wherein the first end member forms a gap between the extending member and the mounting means at the first end.

* * * * *

UNITED STATES PATENT AND TRADEMARK OFFICE

CERTIFICATE OF CORRECTION

PATENT NO. : 7,774,902 B2
APPLICATION NO. : 11/707522
DATED : August 17, 2010
INVENTOR(S) : Robert H. J. Whyzel It is certified that error appears in the above-identified patent and that said Letters Patent is hereby corrected as shown below:

Column 11, Claim 1, Line 63, insert -- having a first end and a second end -- prior to "operable to support a user".

Column 12, Claim 1, Line 2, insert -- (c) mounting flanges disposed at the attachment side of the grab bar, (d) a gap formed between the extending member and the mounting flange at the first end, -- after "said projecting side,".

Signed and Sealed this
Twenty-sixth Day of April, 2011

David J. Kappos

David J. Kappos
*Director of the United States Patent and Trademark Office*